US007392919B2

(12) United States Patent
Uchikoshi

(10) Patent No.: US 7,392,919 B2
(45) Date of Patent: Jul. 1, 2008

(54) SHIRT FINISHING MACHINE

(75) Inventor: Mitsuyuki Uchikoshi, Tokyo (JP)

(73) Assignee: Sankousha Engineering Co., Ltd. (JP)

( * ) Notice: Subject to any disclaimer, the term of this patent is extended or adjusted under 35 U.S.C. 154(b) by 493 days.

(21) Appl. No.: 11/070,737

(22) Filed: Mar. 2, 2005

(65) Prior Publication Data

US 2006/0196897 A1 Sep. 7, 2006

(51) Int. Cl.
*D06C 15/00* (2006.01)

(52) U.S. Cl. ..... 223/72

(58) Field of Classification Search ..... 223/1, 223/52, 57, 66, 70, 73, 76; 38/7, 10, 11, 38/20, 22, 23, 138
See application file for complete search history.

(56) References Cited

U.S. PATENT DOCUMENTS

| | | | | |
|---|---|---|---|---|
| 2,606,272 | A * | 8/1952 | Platt | 392/396 |
| 3,568,900 | A * | 3/1971 | Paris | 223/70 |
| 4,634,030 | A * | 1/1987 | Uchikoshi | 223/57 |
| 6,401,992 | B1 * | 6/2002 | Harrod et al. | 223/73 |
| 6,662,980 | B1 * | 12/2003 | Hickle et al. | 223/57 |
| 6,758,377 | B2 * | 7/2004 | Uchikoshi | 223/73 |
| 6,813,852 | B1 * | 11/2004 | Uchikoshi | 38/66 |
| 7,040,516 | B2 * | 5/2006 | Devrick et al. | 223/73 |
| 2003/0226863 | A1 * | 12/2003 | Hickle et al. | 223/57 |
| 2004/0031824 | A1 * | 2/2004 | Uchikoshi | 223/73 |

* cited by examiner

*Primary Examiner*—Gary L. Welch
*Assistant Examiner*—Andrew W Sutton
(74) *Attorney, Agent, or Firm*—Andrus, Sceales, Starke & Sawall, LLP

(57) ABSTRACT

This invention comprises a torso 2 for putting on a shirt 1, a pair of right and left supporting arms 4 arranged at both sides of the torso 2 and inclined at the side of the torso 2 to draw the sleeve of the shirt 1, and a clamp device 10 arranged at the upper part of the supporting arms 4 for holding and fixing the end segment of the sleeve of the shirt 1. The clamp device 10 is formed in such a way that it can be turned by 90° around the shaft 11 arranged in a direction crossing at a direction crossing at a right angle with a longitudinal direction of the supporting arms 4 and along an inclining direction of the supporting arms 4 and it can be changed over between its vertical orientation and lateral direction. In addition, the clamp device 10 is moved up or down along the longitudinal direction of the supporting arms 4 and its height can be freely adjusted. Application of the present invention enables one clamp device to be changed in its orientation or height and further enables the clamp device to perform a clamp work in an easy manner and without damaging a cloth or a stitching part. With this arrangement, a product price can be made less expensive.

3 Claims, 16 Drawing Sheets

SHIRT FINISHING MACHINE

BACKGROUND OF THE INVENTION

1. Field of the Invention

This invention relates to a shirt finishing machine for use in press finishing a shirt such as a washed white shirt and the like, and more particularly a shirt finishing machine formed to enable wrinkles to be eliminated under a state in which the shirt is put on a torso.

2. Description of the Related Art

As this type of prior art shirt finishing machine, there has been provided the machine described in the gazette of U.S. Pat. No. 6,758,377, for example. This type of prior art shirt finishing machine comprises a torso for putting on a shirt, a pair of front and rear press irons for pressing the front part and the rear part of the torso to press finish the shirt, and a pair of supporting arms installed at both sides of the torso, wherein the upper segments of the supporting arms are provided with clamp devices for use in holding and fixing the sleeve end of a short-sleeve shirt.

Thus, there are present various kinds of sleeves or sleeve ends in the shirt such as a white shirt or a blouse and the like. In addition, a length of the sleeve in the shirt is made different in response to a difference in size and a fixing angle of the sleeve is made different in view of its design. Accordingly, it is preferable in this type of shirt finishing machine that either a clamp orientation or clamp height can be changed or adjusted in compliance with a difference in the short-sleeve or long-sleeve or inclination of the sleeve in such a way that a stitch part of the cloth or the sleeve may not be damaged when the sleeve is pulled and in such a way that the clamp work may easily be carried out.

However, the prior art finishing machine had a clamp device fixed at the upper part of each of the supporting arms in any of the vertical orientation or lateral orientation and could not adjust the height of the clamp device.

Accordingly, the prior art shirt finishing machine had some problems that the sleeve could not be well finished through this prior art because the orientation of the clamp device could not be changed or clamp action could not be performed by adjusting its height.

Further, additionally, in accordance with the prior art shirt finishing machine, it had a problem that a worker for the machine had to raise the hand higher and clamp the sleeve under an uneasy attitude.

In addition, the aforesaid prior art shirt finishing machine was provided with the clamp device for the short-sleeve and the clamp device for the long-sleeve, respectively. Thus, this prior art shirt finishing machine had some problems that either the number of component parts or the number of assembling steps was increased, the component parts cost, assembling cost and manufacturing cost were increased, and the high manufacturing cost was needed.

SUMMARY OF THE INVENTION

As illustrated in FIG. 1 and FIG. 2 and the like, the present invention is constructed such that a clamp device for holding and fixing the sleeve of a shirt is turned by 90° around a shaft arranged along a direction crossing at a right angle with a longitudinal direction of a supporting arm and a slant direction of the supporting arm and formed in such a way that the clamp device can be freely changed over between a vertical orientation and a lateral direction, and the clamp device is formed in such way that it can be freely moved along a longitudinal direction of the supporting arm.

Accordingly, the present invention enables an orientation of the clamp device to be changed in compliance with a form of the end segment of the sleeve or a length of the sleeve or a slant of the sleeve and the height of the clamp device to be adjusted. Accordingly, the present invention enables a worker to perform the clamp work for the sleeve in an easy manner, to clamp the sleeve without damaging either the cloth or the stitch part and then to finish the sleeve in a neat manner.

Additionally, the present invention enables the component parts cost and their assembling cost to be reduced and a price of product to be less-expensive because both the short-sleeve shirt and the long-sleeve shirt can be clamped with one clamp device installed at the upper segment of the supporting arm.

The shirt applied to the present invention includes, in addition to a white shirt, a polo shirt or a blouse and the like, for example. Further, as the shirt, either a short-sleeve or a long-sleeve may be applied. As the device for changing either an orientation or a height of the clamp device applied in the present invention, there may be provided a cylinder device such an air cylinder or a motor. In addition, there may be provided in the present invention a heat iron that is installed at the upper segment of the supporting arm in such a way that the tuck of a shirt can be press finished while the end segment of the sleeve is being fixed by the clam device. Additionally, the present invention may be formed while being provided with a press iron for use in press finishing the front part and the rear part of a shirt or only one of the front part and the rear part.

Thus, it is preferable that as shown in FIG. 6, the present invention is formed with a sensor for outputting a signal when the sleeve of a shirt reaches a limit of pulling state and a controller for receiving a signal from the sensor and outputting a stop signal for inclining operation to a driving device for the supporting arm.

This type of prior art finishing machine was usually operated such that even if the type of cloth of the shirt was different, the supporting arm was inclined to its side part through extending operation of the rod of a cylinder to draw the sleeve and the sleeve was bulged out and finished under a state in which a weight of the supporting arm was applied to the sleeve. Accordingly, the prior art shirt finishing machine was operated such that the sleeve was pulled with a self-weight of the supporting arm and the cloth or the stitch fixing part of the sleeve was easily damaged. However, the present invention shown in FIG. 6 can eliminate or overcome such a problem as above. That is, when the sleeve reaches its limited state of being pulled in the present invention, the sleeve can be prevented from being pulled further or the sleeve can be prevented from being applied with a weight of the supporting arm. Accordingly, the present invention enables the sleeve to be finished neat without damaging the sleeve or the stitch fixing part of the sleeve. The limit of the sleeve pulling state in this case is meant by an ultimate interface in which when the supporting arm is further inclined to cause the sleeve to be pulled, the cloth or the stitch fixing part of the sleeve is damaged. As the sensor, there may be provided a photo-electrical sensor or a limit switch and the like. As the driving device for the supporting arm, there may be provided an air cylinder or a motor. The controller may be constituted by either a micro-computer or a sequencer and the like.

In addition, as shown in FIGS. 10 to 14 and the like, it is preferable that the present invention is formed to have a blower for use in adsorbing a shirt against a torso while sucking the inner side of the torso and for feeding air into the sleeve of the shirt through the inner side of the torso, and a flow path changing-over device for use in changing over an air path selectively connecting the blower with the inner side of the torso in their communicated state at the time of sucking air and at the time of air blowing operation, respectively.

This type of prior art shirt finishing machine is usually constructed such that a vacuum-type blower for adsorbing a shirt against a torso and another blower for use in feeding air into the sleeve of a shirt, bulging out the sleeve and finishing it in tension are separately installed. Accordingly, the prior art shirt finishing machine needed two blowers, so that its cost was increased and its size was made large or its weight was increased. However, the present invention illustrated in FIG. 10 and the like can overcome or eliminate such problems as above. That is, when the present invention is applied, the shirt can be adsorbed against the torso with one blower or the bulging-out finishing of the sleeve can be carried out. Accordingly, the present invention enables the component parts cost or assembling cost to be reduced and further enables a space saving, a small-size formation and a light weight device to be attained.

In addition, it is preferable in the present invention that the clamp device is formed such that it can be freely raised up around a horizontal lateral shaft along its forward or rearward direction as shown in FIG. 15 and the like.

Because, in accordance with this arrangement, even if the sleeves are suspended down straight as found in a suite, for example, the clam device can be arranged accurately in opposition to the end segment of the sleeve and the end segment of the sleeve can be clamped positively and neat. The raised state defined in this case is not limited to 90°. Further, the raising operation of the clamp device in the present invention is realized more practically by either an air cylinder or a motor.

DETAILED DESCRIPTION OF THE PREFERRED EMBODIMENTS

Figure 1:
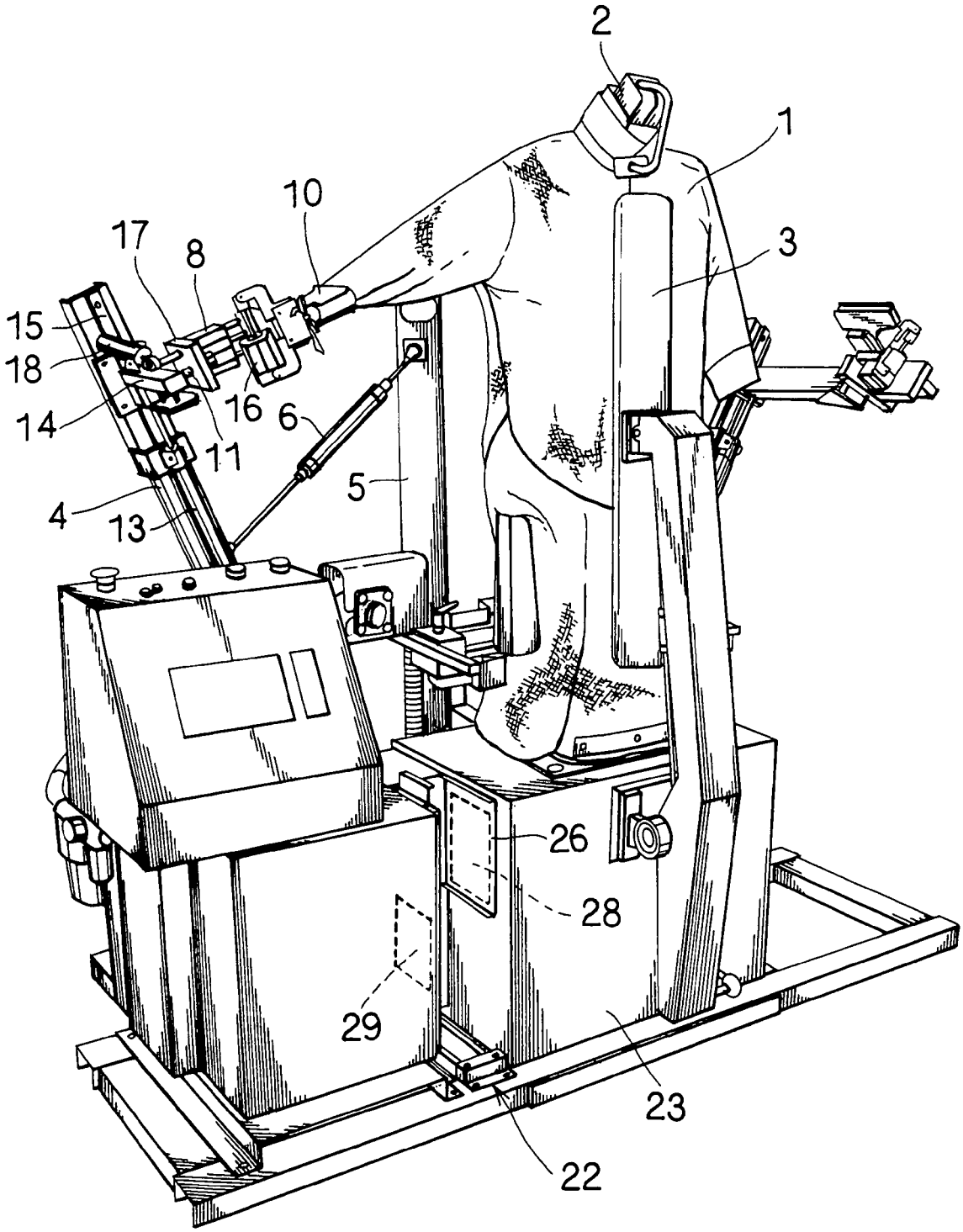
FIG. 1 is a substantial perspective view for showing a state of use of one preferred embodiment of the shirt finishing machine of the present invention.
Figure 2:
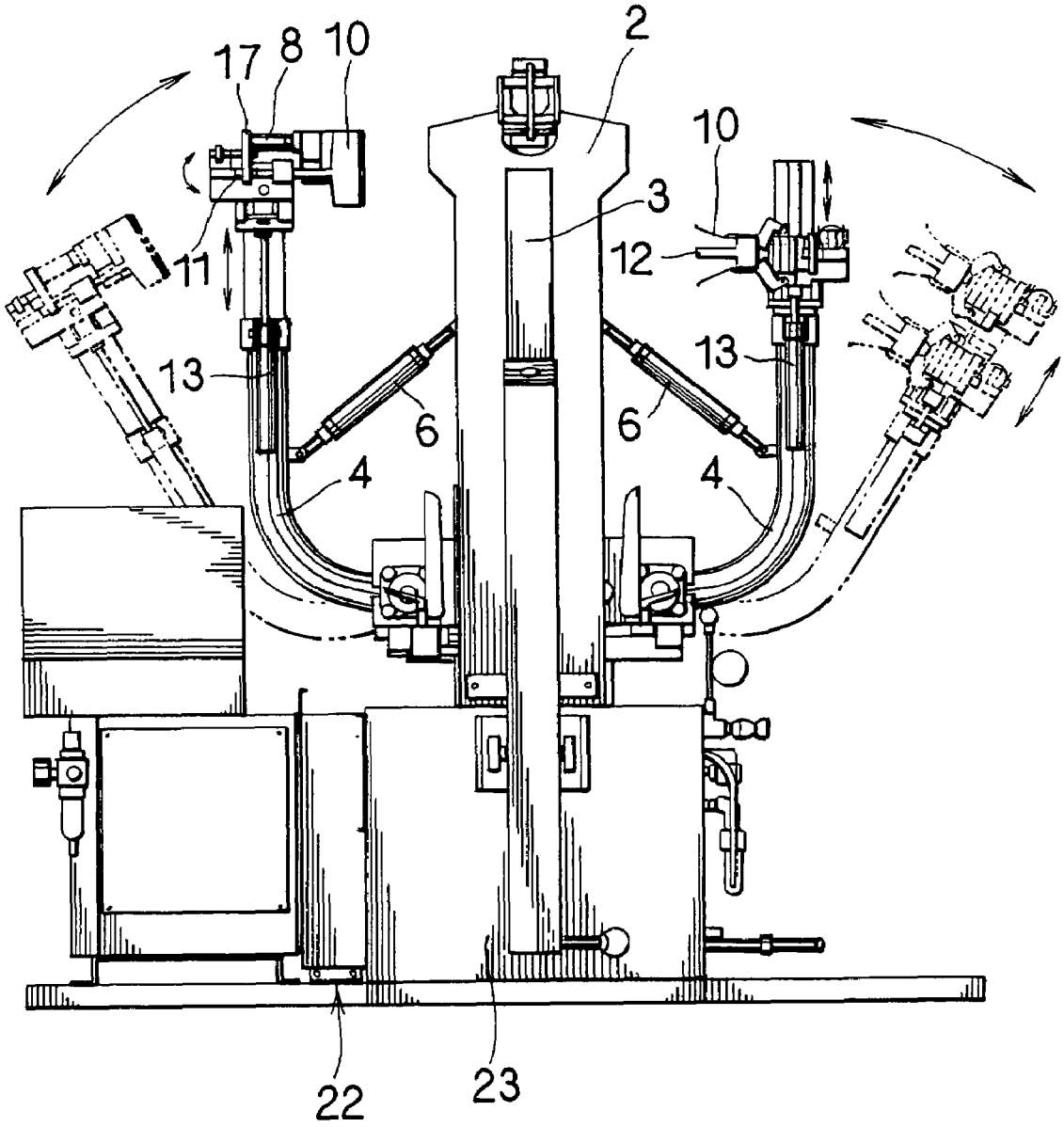
FIG. 2 is a front elevational view for illustrating an action of the shirt finishing machine.
Figure 3:
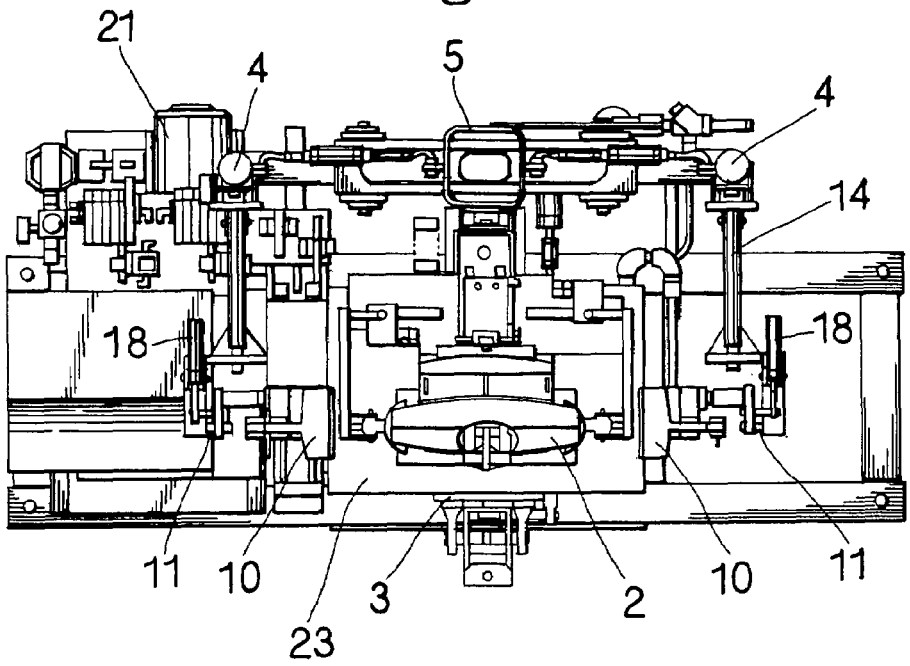
FIG. 3 is a top plan view for illustrating the shirt finishing machine.
Figure 4:
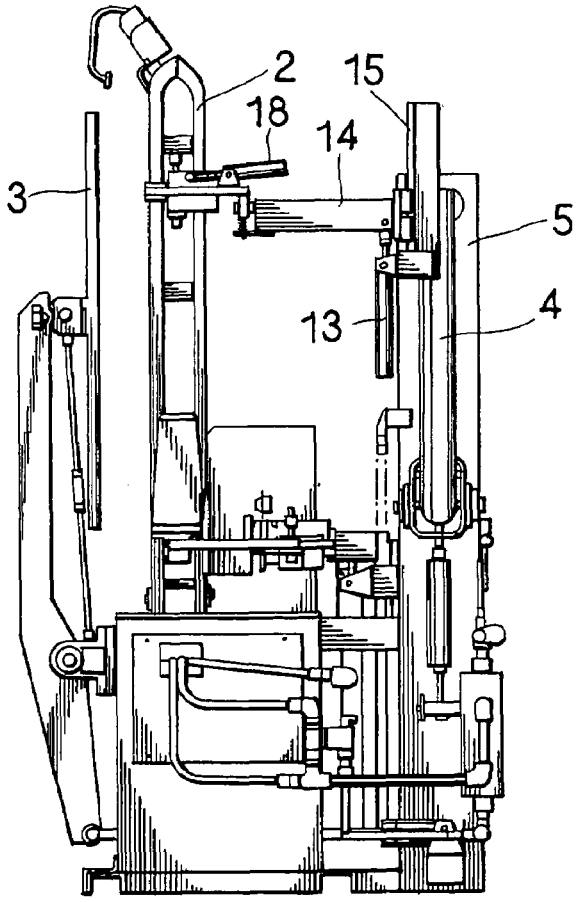
FIG. 4 is a right side elevational view for illustrating an action of the shirt finishing machine.
Figure 5:
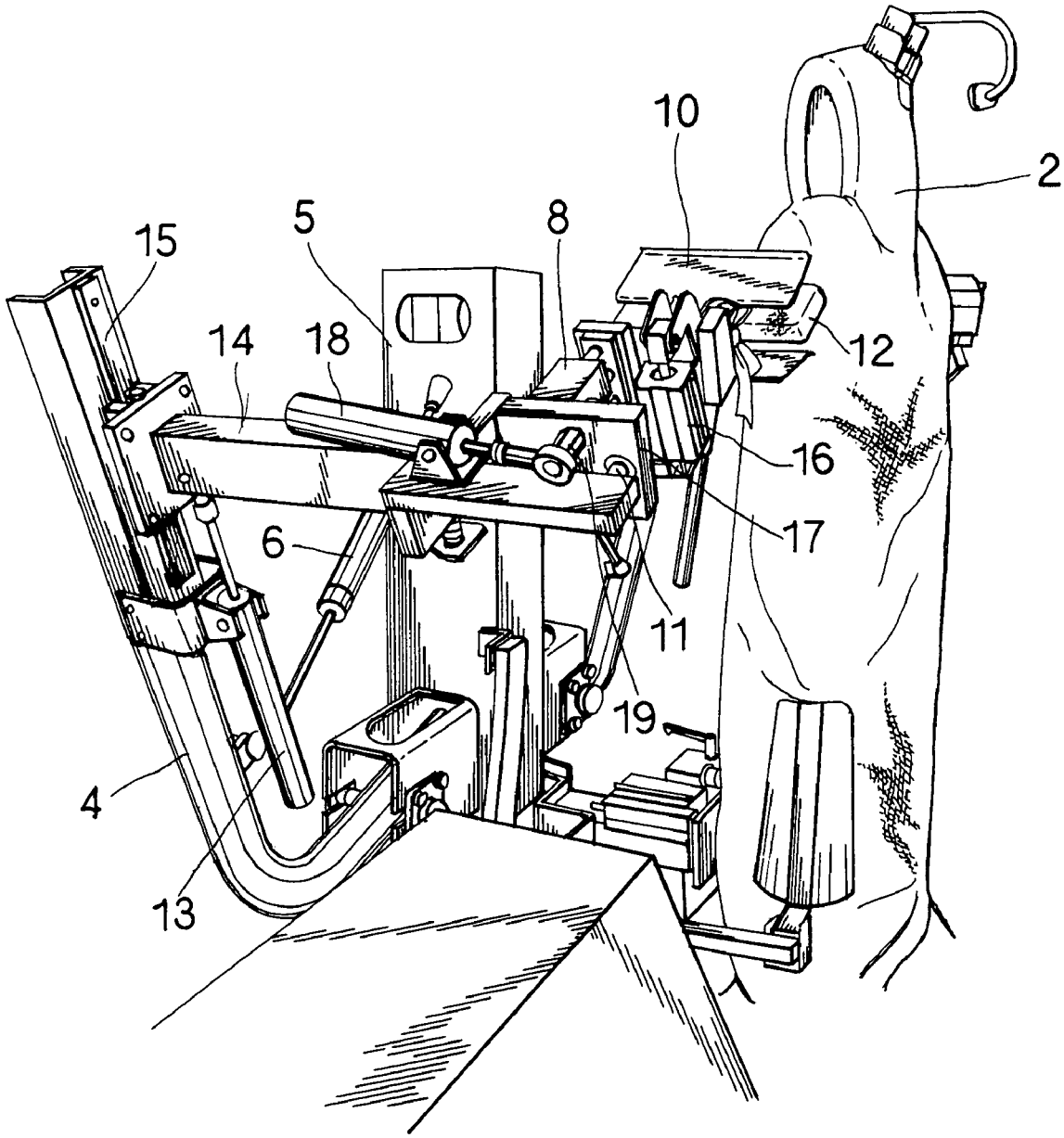
FIG. 5 is a substantial perspective view for showing the shirt finishing machine.

The preferred embodiments of the present invention will be described as follows.

Reference numeral 1 denotes a short-sleeve white shirt applied as a shirt. Reference numeral 2 denotes a torso for use in wearing the shirt 1. In addition, reference numeral 3 denotes a press iron for use in depressing the front side of the shirt 1. The press iron 3 is arranged in such a way that it may be turned in a forward or rearward direction of the torso 2 around its lower pivoted location.

Reference numeral 4 denotes a pair of right and left supporting arms arranged at both sides of the torso 2 and inclined at the side portions of the torso 2 to draw the sleeves of the shirt 1. The lower ends of the supporting arms 4 are rotatably attached at both sides of a column 5 stood at the rear side of the torso 2. In addition, reference numeral 6 denotes a driving device for the supporting arms 4. The air cylinder acting as the driving device 6 is applied in a slant manner between the position about a middle of the supporting arm 4 and the column 5. The supporting arm 4 is raised up through retraction or extension of a rod of the air cylinder acting as the driving device 6 toward the torso 2 around its lower end fixing location or turned from the torso 2 toward a side part of it and inclined.

Figure 6:
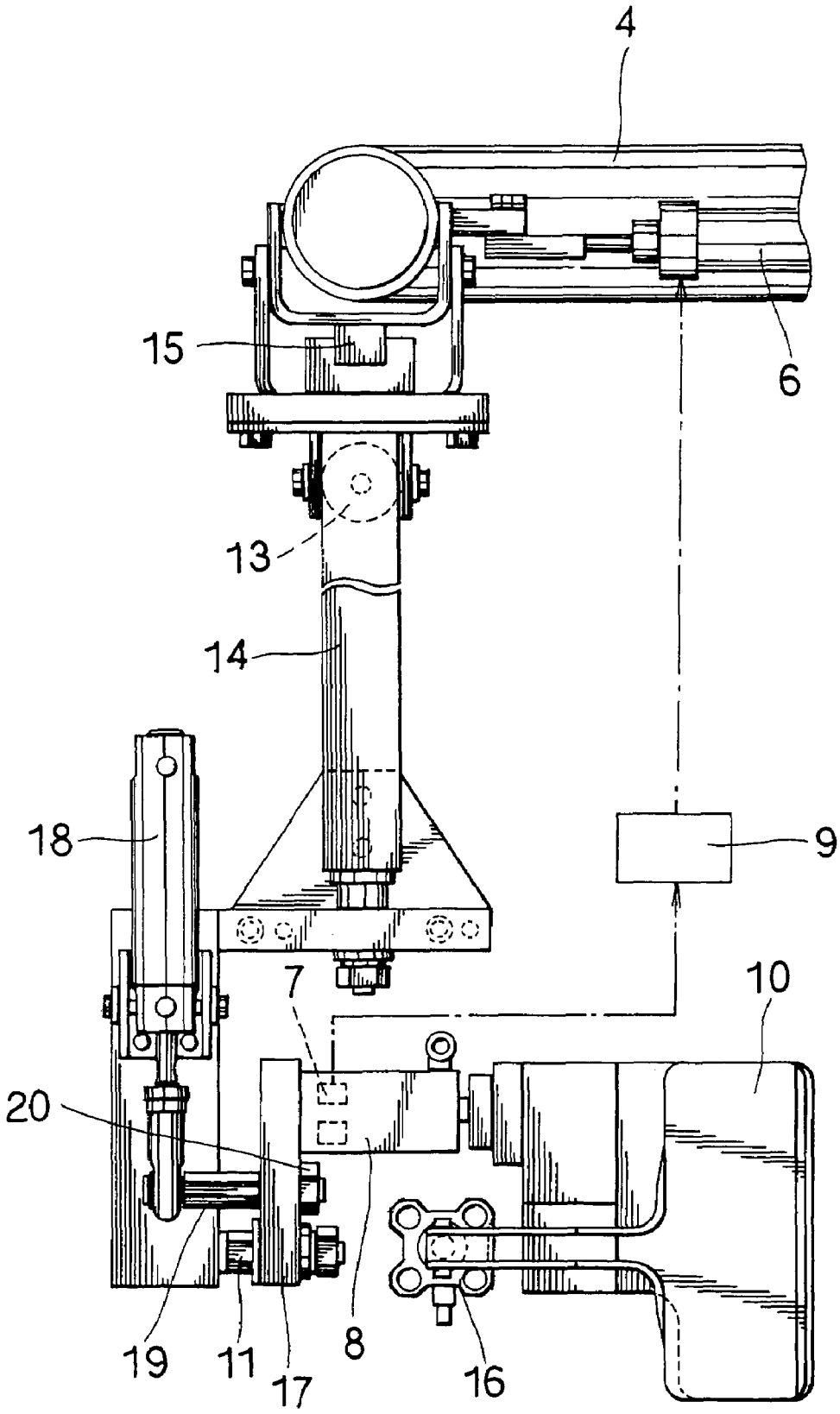
FIG. 6 is a substantial top plan view for showing the shirt finishing machine.
Figure 7:
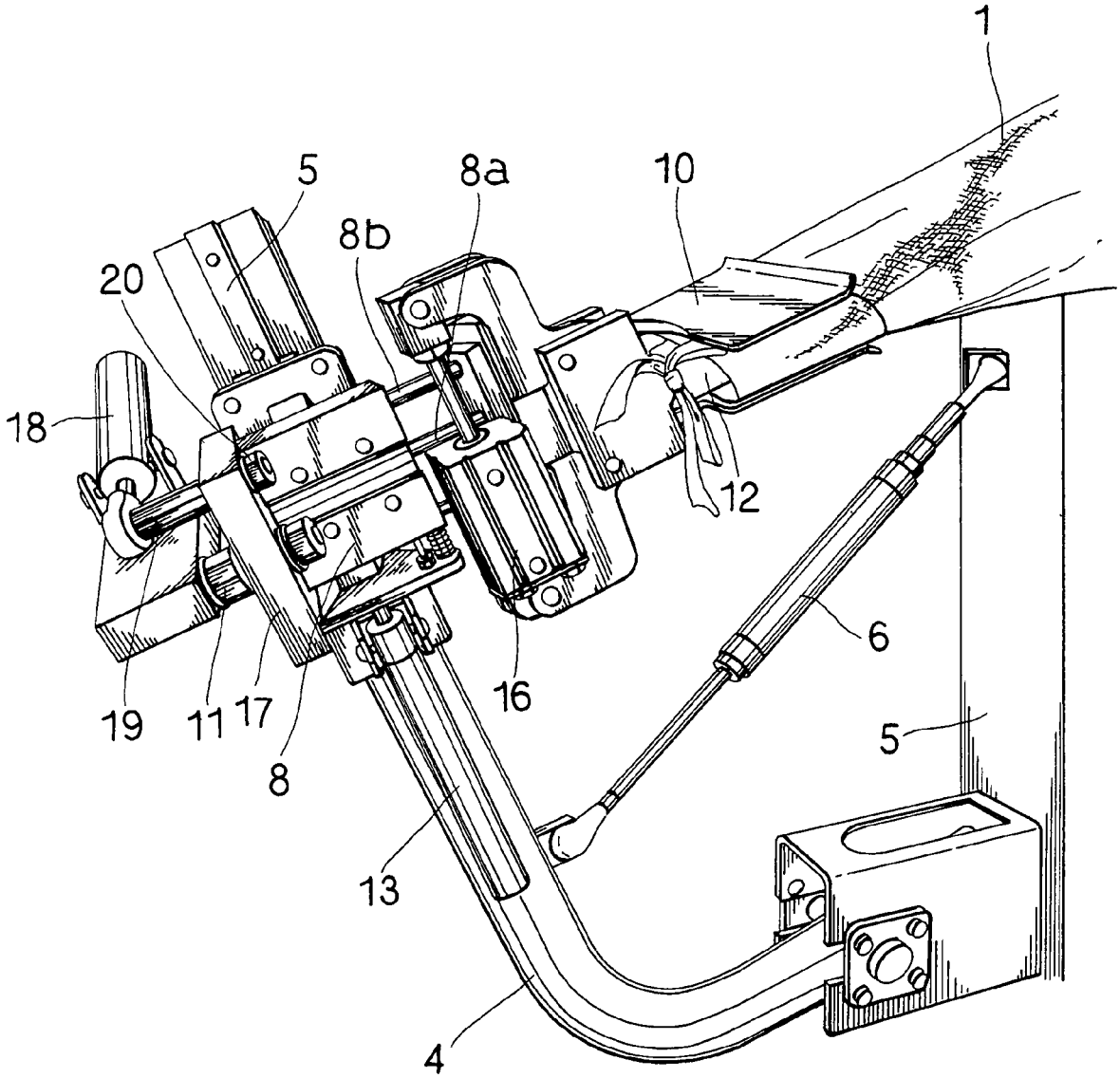
FIG. 7 is a substantial perspective view for showing the shirt finishing machine.
Figure 8:
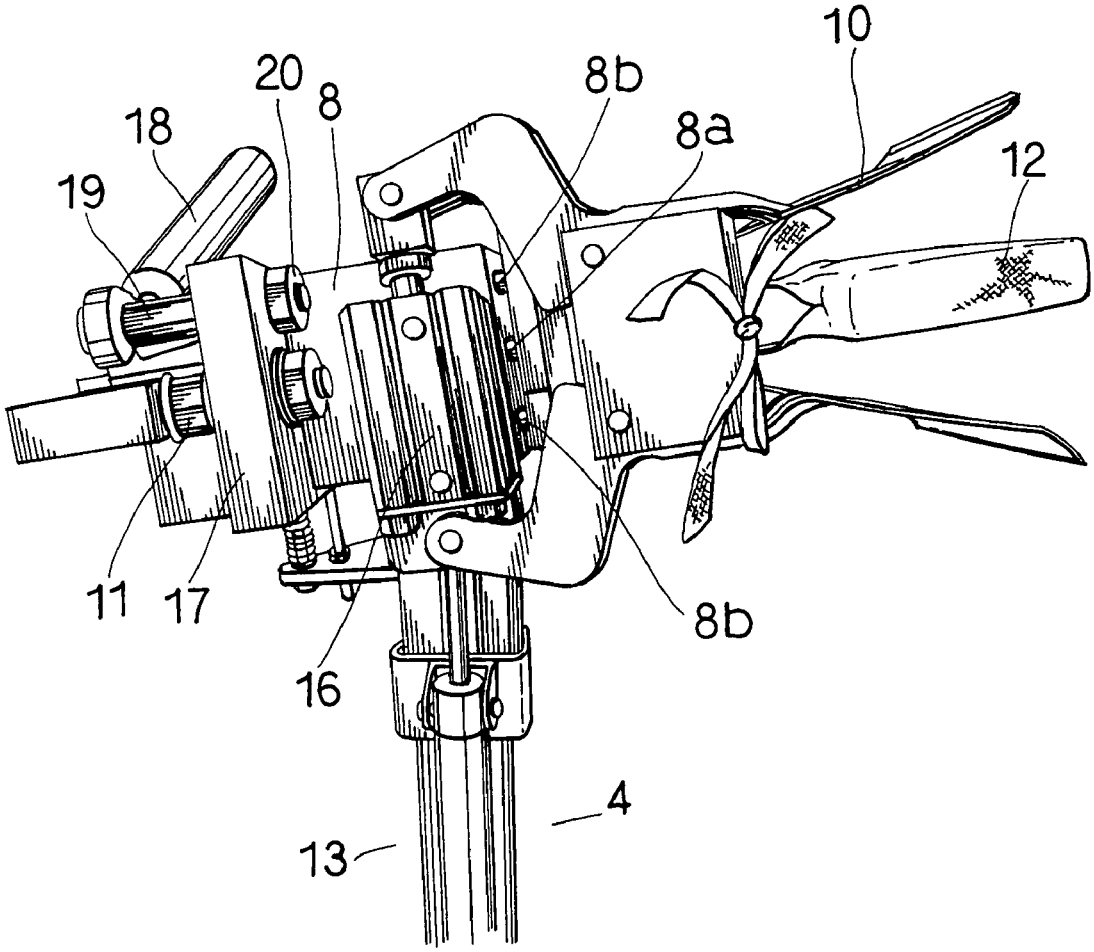
FIG. 8 is a substantial perspective view for showing the shirt finishing machine.

Thus, the supporting arms 4 are formed such that when the sleeve of the shirt 1 reaches a limit of the drawing state, the air cylinder acting as the driving device 6 is stopped and the supporting arms are stopped at that position. Reference numeral 7 (refer to FIG. 6) denotes a sensor for outputting a signal when the sleeves of the shirt reach the limit of the drawing state. The sensor 7 is constituted by a photo-electrical sensor, for example, and stored in a cylinder 8 having a guide. Then, the sensor 7 is formed such that an ON signal is outputted when an inner end of a rod 8*a* of the cylinder 8 having the guide is released from between a light receiving part and a light projecting part. Reference symbol 8*b* denotes a pair of parallel rod-like guides. The rod 8*a* is arranged in parallel between the guides 8*b*. In addition, reference numeral 9 denotes a controller for use in outputting a stop signal for an inclining operation to the air cylinder acting as the driving device 6 for the supporting arm 4 upon receiving the output signal from the sensor 7. The controller 9 is constituted by a micro-computer, for example.

Reference numeral 10 denotes a clamp device installed at the upper segment of the supporting arm 4 to hold and fix the end segment of the shirt 1. The clamp device 10 is formed such that it is turned around a shaft 11 by 90° and it can be changed over between the vertical orientation and the horizontal orientation. The shaft 11 is arranged in a direction crossing at a right angle with a longitudinal direction of the supporting arm 4 and a direction along an inclining direction of the supporting arm 4. Reference numeral 12 denotes a pad for use in inserting the end segment of the sleeve of the shirt 1. The end segment of the sleeve of the shirt 1 is held by the clamp device 10 through the pad 12.

In addition, the clamp device 10 moves up and down along the longitudinal direction of the supporting arm 4 and is formed such that its height can be freely adjusted. Reference numeral 13 denotes a first air cylinder for use in moving up or down the clamp device 10. The first air cylinder 13 is fixed to the supporting arm 4 along its longitudinal direction under a state in which the rod is faced upward. Reference numeral 14 denotes a frame extending in a forward or rearward direction and arranged in a horizontal manner. The upper end of the rod of the first air cylinder 13 is connected to the rear end of the frame 14. The frame 14 is engaged with a guide rail 15 fixed to the front surface of the supporting arm 4, guided by this guide rail 15 and formed such that it can be moved up and down. The clamp device 10 has a second air cylinder 16 between the bent legs and is formed such that it can be freely opened or closed through an extending or retracting operation of the rod of the second air cylinder 16.

In addition, the clamp device 10 is connected to the cylinder 8 having the guide through the rod 8*a* and the guide 8*b*. A plate 17 is fixed in perpendicular to the cylinder 8 having a guide, and the plate 17 and the shaft 11 are connected such that the plate 17 can be turned around the shaft 11. The shaft 11 is fixed to the front end of the frame 14 in a state to be crossed at a right angle with the longitudinal direction of the frame 14. Reference numeral 18 denotes a third air cylinder for use in changing-over the clamp device 10 around the shaft 11 by 90° between its vertical orientation and lateral orientation. This third air cylinder 18 has a rod directed in a forward direction and is pivotally arranged at the frame 14. Then, the extremity end of the rod of the third air cylinder 18 is pivoted at one end of the connecting rod 19 arranged in parallel with the shaft 11. The other end of the connecting rod 19 is fixed at a predetermined position of the plate 17 with a nut 20.

In addition, the shirt finishing machine of the present invention is constituted such that, as shown in FIGS. 10 to 14 and the like, there are provided a blower 21 for sucking the inner side of the torso 2 to cause the shirt 1 to be adsorbed against the torso 2 and at the same time for feeding air into the sleeve of the shirt 1 through the inner part of the torso 2; and a flow path changing-over device 22 for use in changing-over a flow path for air connecting the blower 21 with the inner side of the torso 2 in a communicated state at the time of sucking air and at the time of blowing air.

Figure 11:
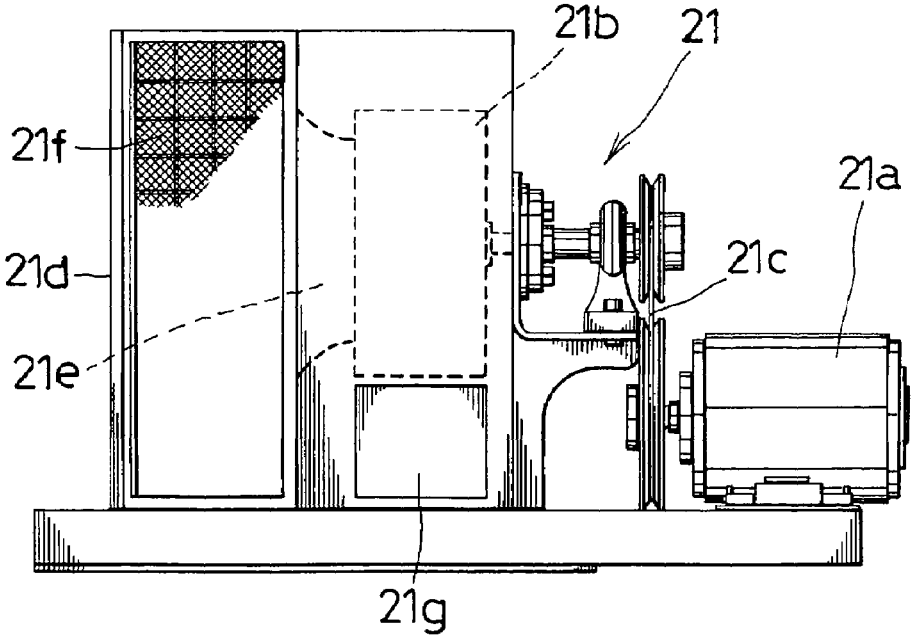
FIG. 11 is a side elevational view for showing a blower.

As shown in FIG. 11, the blower 21 is constructed such that the rotating shaft of the motor 21*a* and the rotating shaft of a vane 21*b* are connected by a transmission belt 21*c*, and the vane 21*b* is stored in a casing 21*d*. Reference symbol 21*e* denotes a suction cone. Reference symbol 21*f* denotes a suction port having a filter therein. Reference numeral 21*g* denotes a supplying/discharging port. The flow-path changing-over device 22 is installed between the casing 21*d* of the blower 21 and a base part 23 of the torso 2.

In addition, the flow-path changing-over device 22 is constituted by a flow-path changing-over box 22*a*, an air cylinder acting as a driving source 22*b* for advancing or retracting the flow-path changing-over box 22*a*, and a pair of parallel guide members 22*c* for use in guiding the flow-path changing-over box 22*a*.

Figure 13:
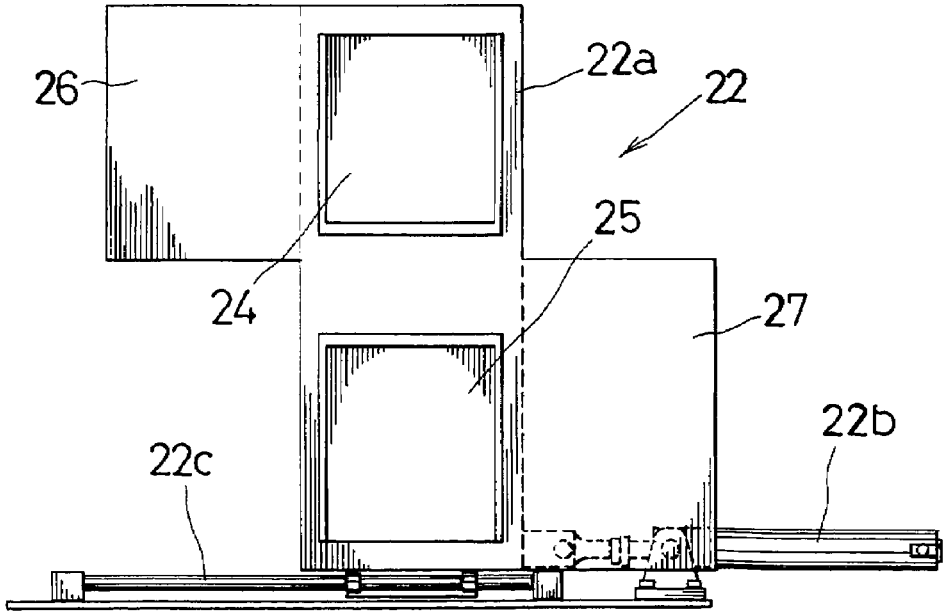
FIG. 13 is a side elevational view taken along line XIII-XIII of FIG. 12.

As shown in FIG. 13, the flow-path changing-over box 22*a* is formed such that the upper and lower positions of the side surface are opened to pass from one side to the other side in their communicated state, the upper side is formed with a suction path 24 and the lower side is formed with an air feeding path 25. In addition, as shown in said figure, the flow path changing-over box 22*a* is constructed such that a shielding plate 26 for the discharging port and a shielding plate 27 for the suction port are protruded at a side in flush with the side surface of the flow path changing-over box 22*a* at the slant upper side and the slant lower side, respectively.

As shown in FIG. 1, the shielding plate 26 for the discharging port is applied for closing the discharging port 28 opened at the side surface of the base part 23 of the torso 2 and the shielding plate 27 for the suction port closes the suction port 29 (refer to FIG. 1), respectively, in response to the forwarding or retracting operation of the flow-path changing-over box 22*a*. Accordingly, as shown in FIG. 1, the discharging port 28 and the suction port 29 are displaced in a slant direction at the side surface of the base part 23 in compliance with the forming positions of each of the shielding plates 26, 27.

An action of the present invention in accordance with this preferred embodiment will be described as follows.

At first, a worker puts on the shirt 1 on the torso 2, then holds and fixes the end segment of the shirt 1 with the clamp device 10 under a state in which the supporting arms 4 are arranged near the torso 2. At this time, the worker adjusts either an orientation or a height of the clamp device 10 in compliance with either a length or an inclination of the sleeve and a form of the end segment of the sleeve or the like. When it is desired to lower the height of the clamp device 10, the rod of the first air cylinder 13 is retracted. Then, the frame 14 descends along the guide rail 15 and the clamp device 10 is arranged at the low position together with this frame 14. With this arrangement as above, the present invention enables the sleeve to be easily set.

Figure 9:
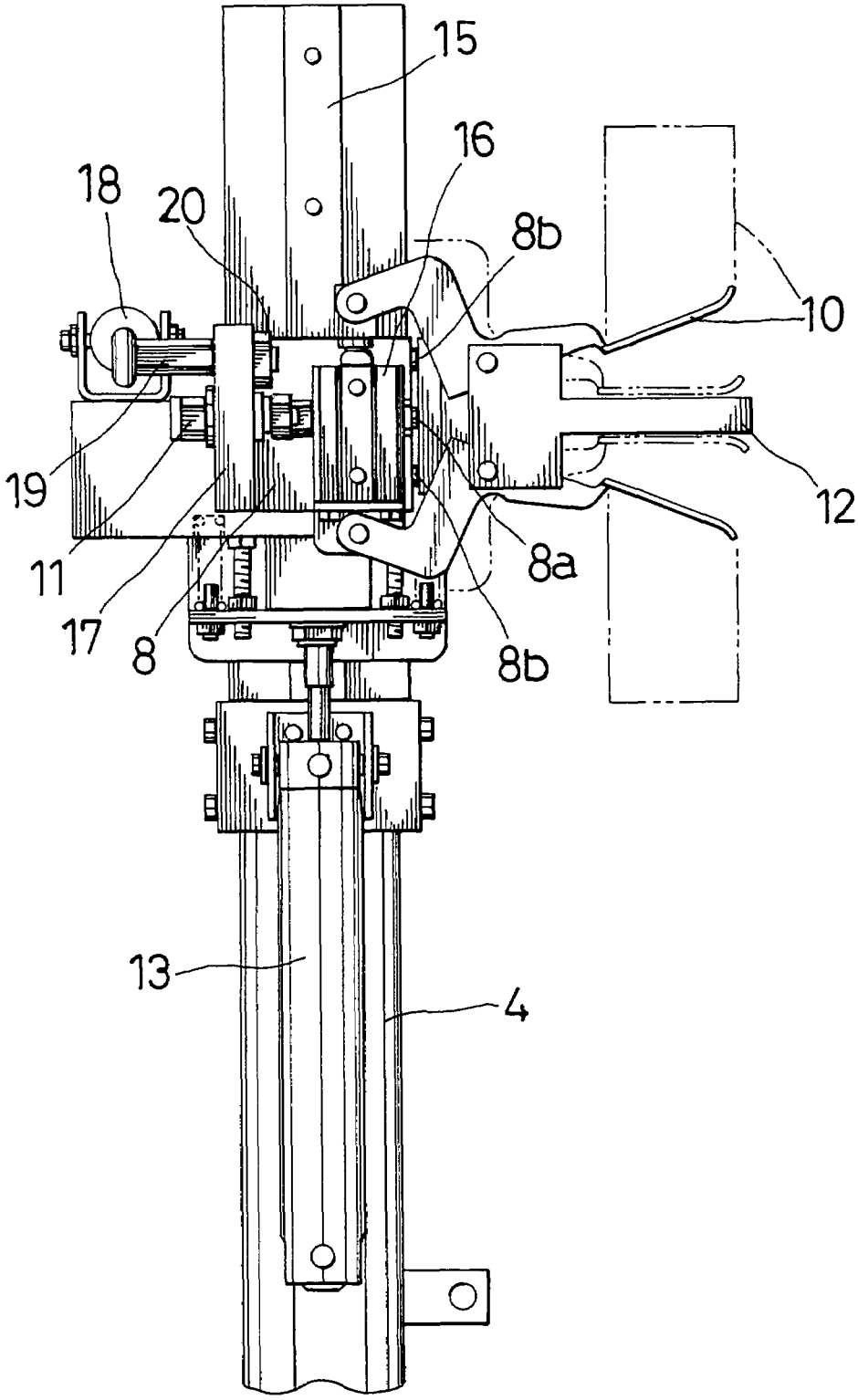
FIG. 9 is a substantial front elevational view for showing the shirt finishing machine.

Further, the preferred embodiment is constructed such that the clamp device 10 is moved up and down under a driving action of the first air cylinder 13 while the driving switch for the first air cylinder 13 is being depressed. In addition, when the worker wants to change an orientation of the clamp device 10, the worker depresses the driving switch for the third air cylinder 18. Then, the third air cylinder 18 is driven, its rod extends and an entire assembly of the plate 17, the cylinder 8 having the guide and the clamp device 10 is turned by 90° around the shaft 11. With this arrangement as above, the clamp device 10 is arranged in a vertical orientation, for example (refer to the state indicated by a dotted chain line in FIG. 9).

Thus, after the end segment of the sleeve is held with the clamp device 10 in this way, the worker turns on a switch for the air cylinder acting as the driving device 6 to extend the rod. Then, the supporting arms 4 are turned to the side part of the torso 2 and inclined against it. Then, when the sleeve of the shirt 1 reaches the limit of the drawing state, the sensor 7 is turned on. When the controller 9 receives this signal, the controller 9 sends a driving stop signal to the air cylinder acting as the driving device 6. With this arrangement as above, driving of the driving device 6 is stopped and the supporting arms 4 stand still.

Figure 14:
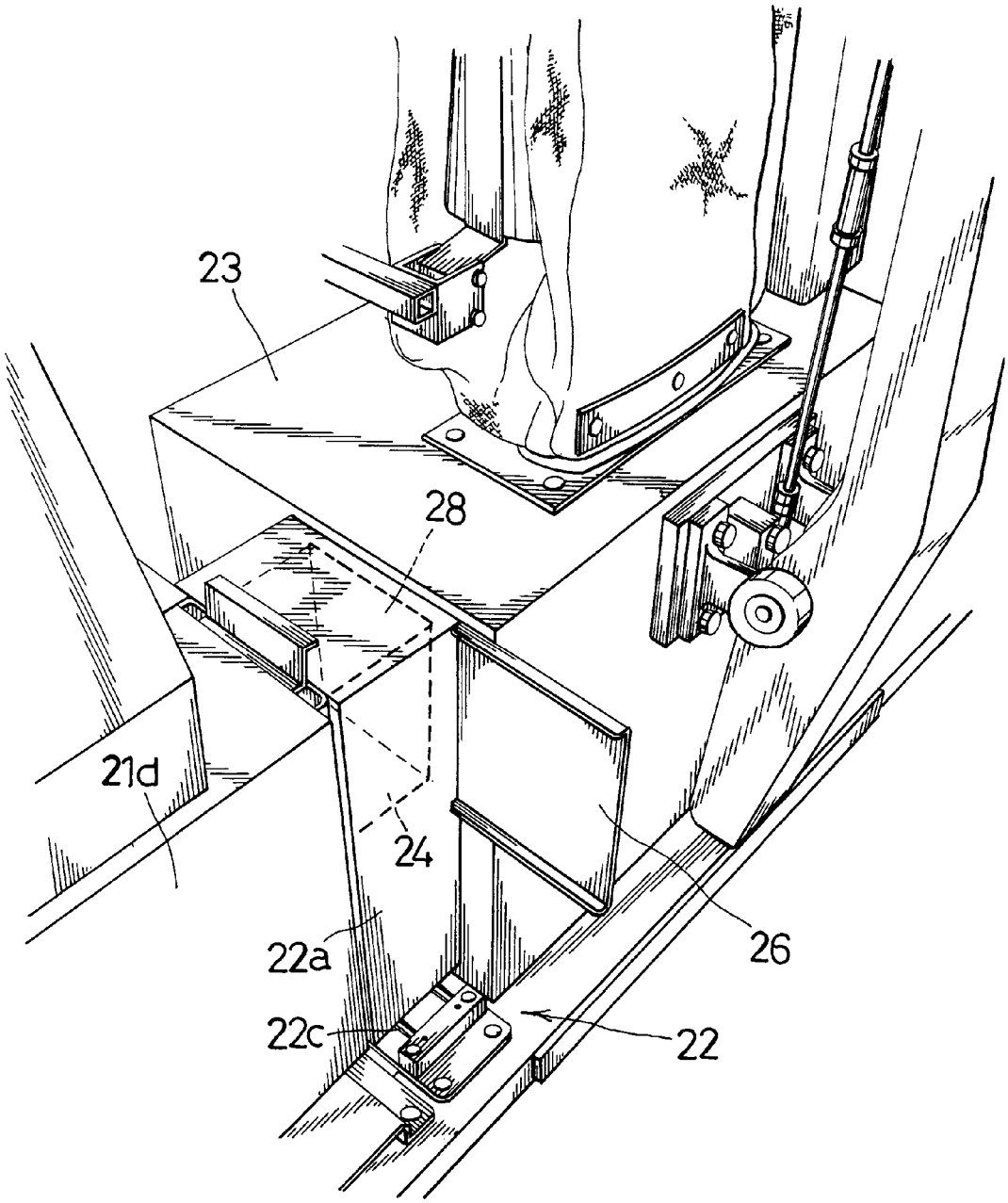
FIG. 14 is a substantial perspective view for illustrating an action of the shirt finishing machine.

Thus, when the shirt 1 is adsorbed against the torso 2, the rod of the air cylinder acting as the driving source 22*b* (refer to FIG. 12) extends. Then, as indicated in FIG. 14, the flow-path changing-over box 22*a* is guided by the guide member 22*c*, advances and then the discharging port 28 of the base part 23 is communicated with the upper suction path 24 of the flow-path changing-over box 22*a*. At this time, the shielding plate 27 for the suction port of the flow-path changing-over box 22*a* (refer to FIG. 13) closes the suction port 29 of the base part 23 (refer to FIG. 1). When the blower 21 is operated under this state, air in the torso 2 is sucked and the shirt 1 is adsorbed against the surface of the torso 2. Then, the air flows from the discharging port 28 to the suction path 24 of the flow-path changing-over box 22*a*, enters into the casing 21*d* through the suction port 21*f* having the filter of the casing 21*d*

(refer to FIG. 11) and the air is discharged from the supplying or discharging port 21*g* of the casing 21*d*.

Figure 10:
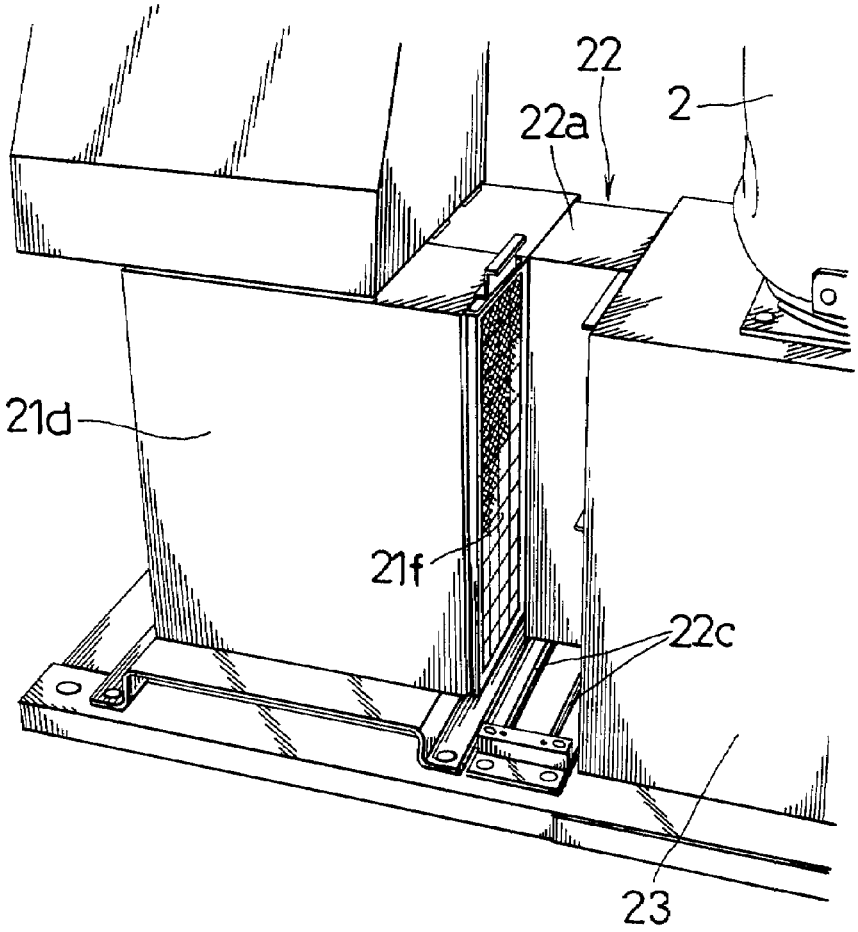
FIG. 10 is a substantial perspective view for showing the shirt finishing machine.
Figure 12:
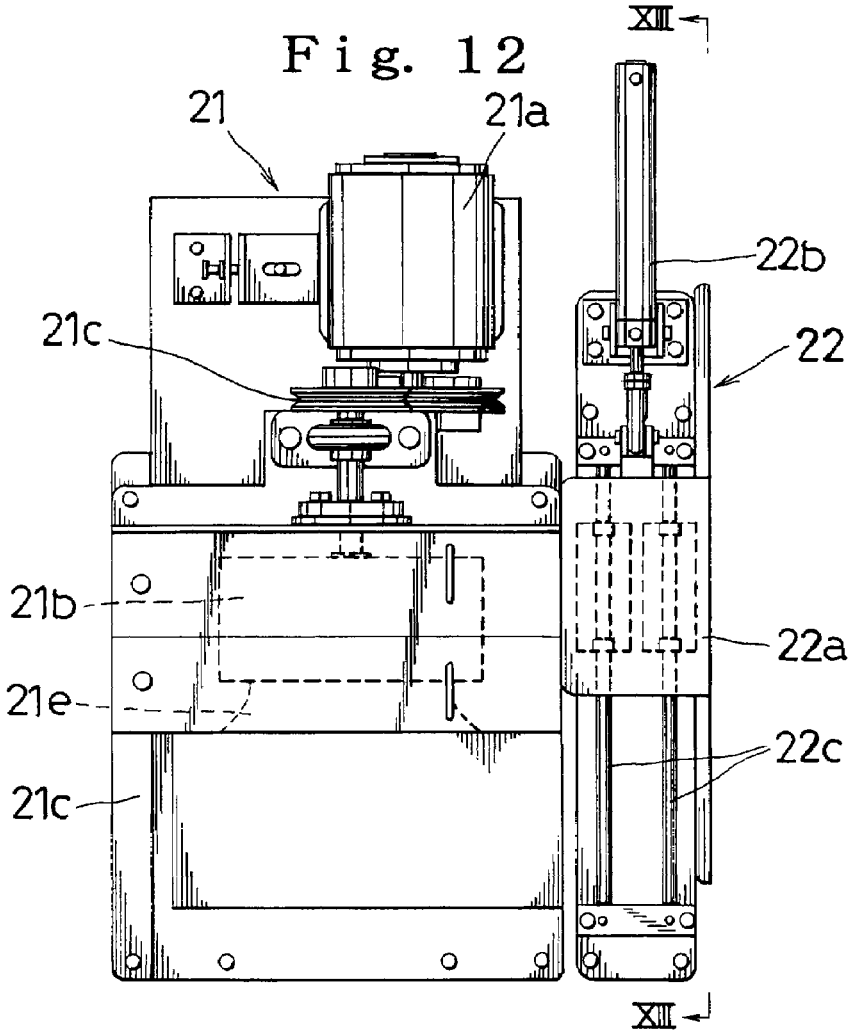
FIG. 12 is a top plan view for showing a blower and a flow path changing-over device.

In addition, when the sleeve is bulged out, the rod of the air cylinder acting as the driving source 22*b* is retracted. Then, the flow-path changing-over box 22*a* is guided by the guide member 22*c* and retracted. Then, as shown in FIGS. 1, 10 and 12, the air feeding path 25 (refer to FIG. 13) is communicated with the suction port 29 of the base part 23 and the supplying or discharging port 21*g* of the casing 21*d*. In this case, as shown in FIG. 1, the discharging port 28 of the base part 23 is closed by the shielding plate 26 for the discharging port. When the blower 21 is operated under this state, surrounding atmosphere is sucked at the suction port 21*f* having the filter of the casing 21*d*. Then, this air flows at the supplying or discharging port 21*g*, air feeding path 25, suction port 29 and inside the torso 2 and is fed into the sleeve of the shirt 1. With this arrangement as above, the sleeve is bulged out and finished.

Figure 15:
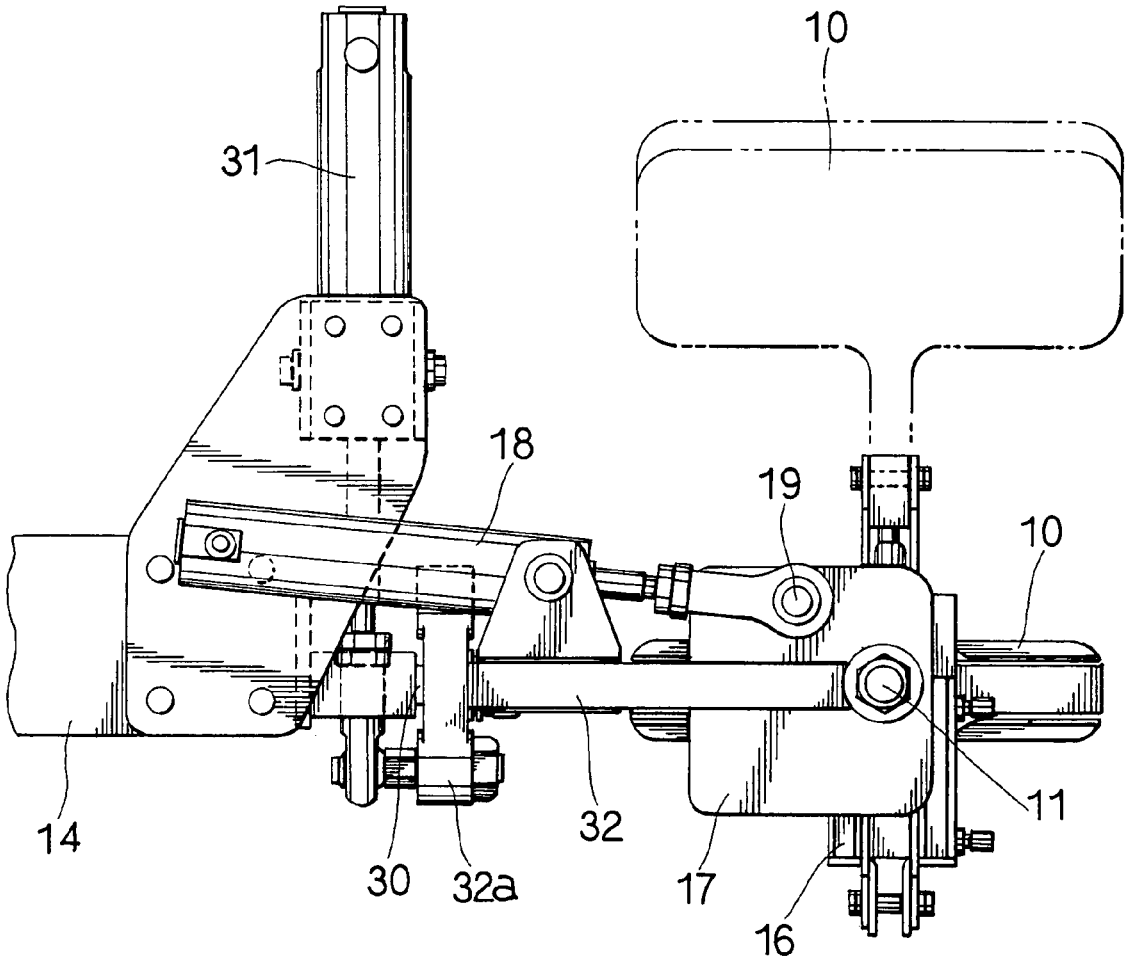
FIG. 15 is a substantial side elevational view for showing another preferred embodiment of the shirt finishing machine.
Figure 16:
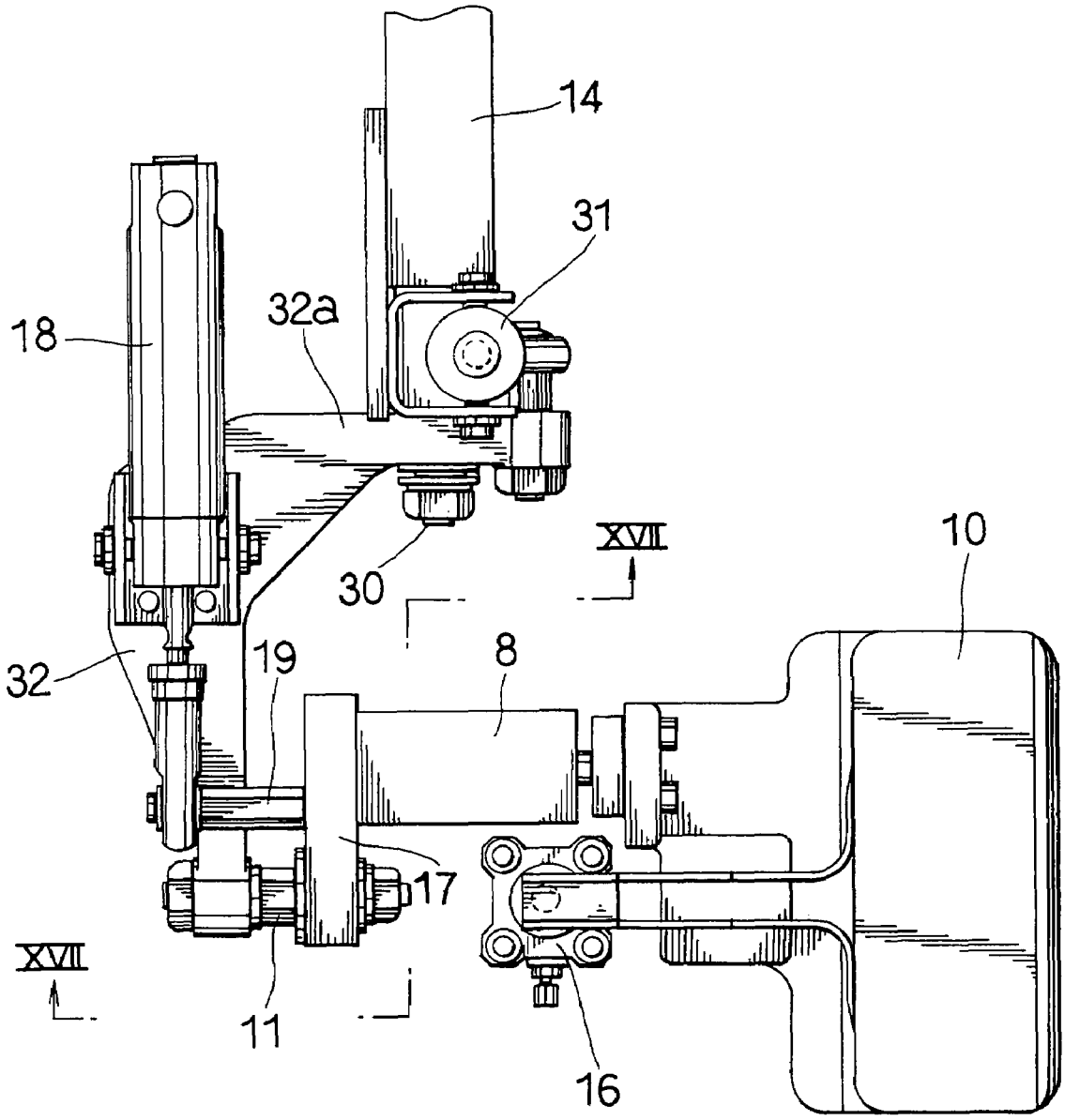
FIG. 16 is a substantial top plan view for showing the preferred embodiment of FIG. 15.
Figure 17:
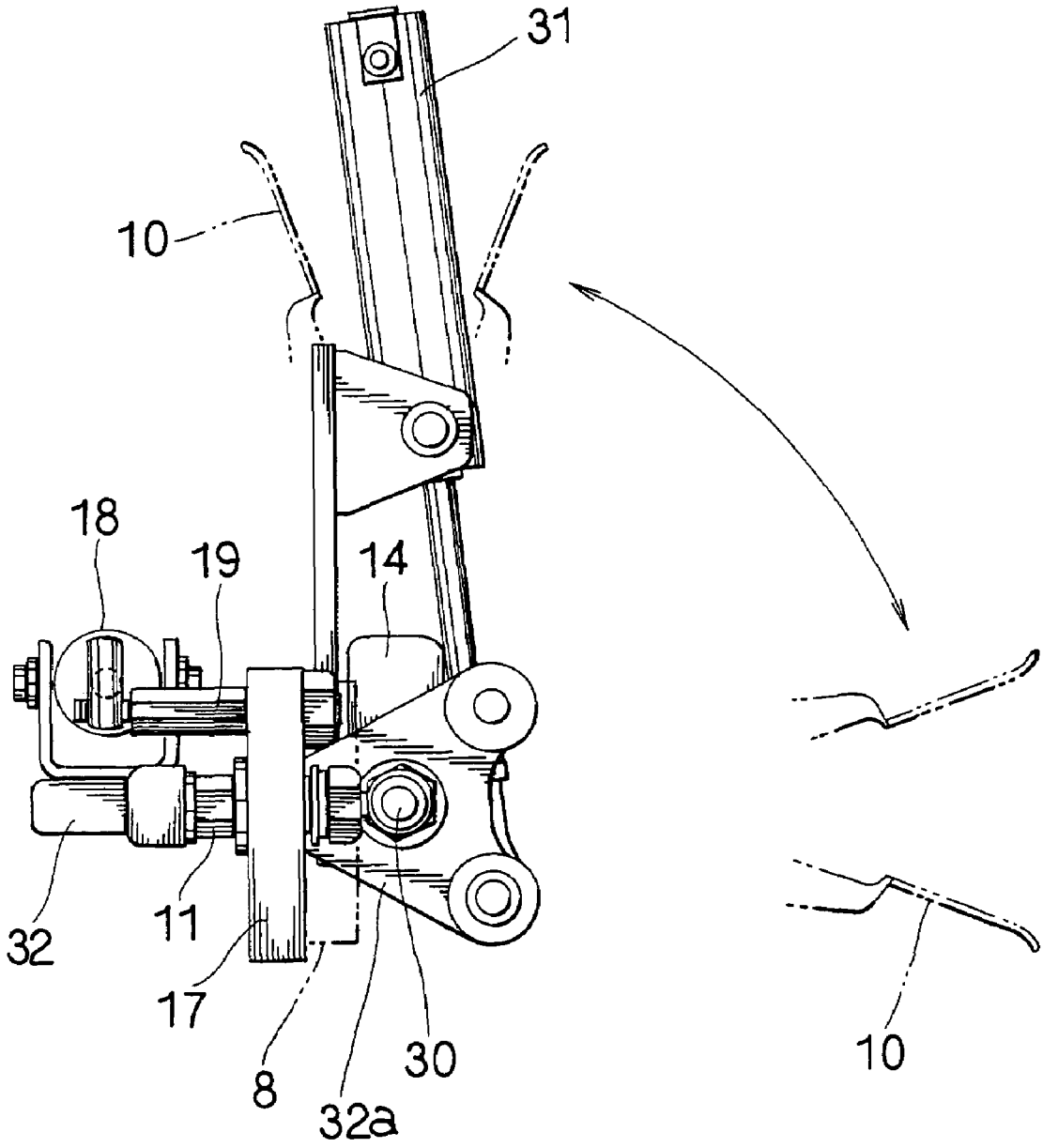
FIG. 17 is a substantial front elevational view taken along line XVII-XVII of FIG. 16.
Figure 18:
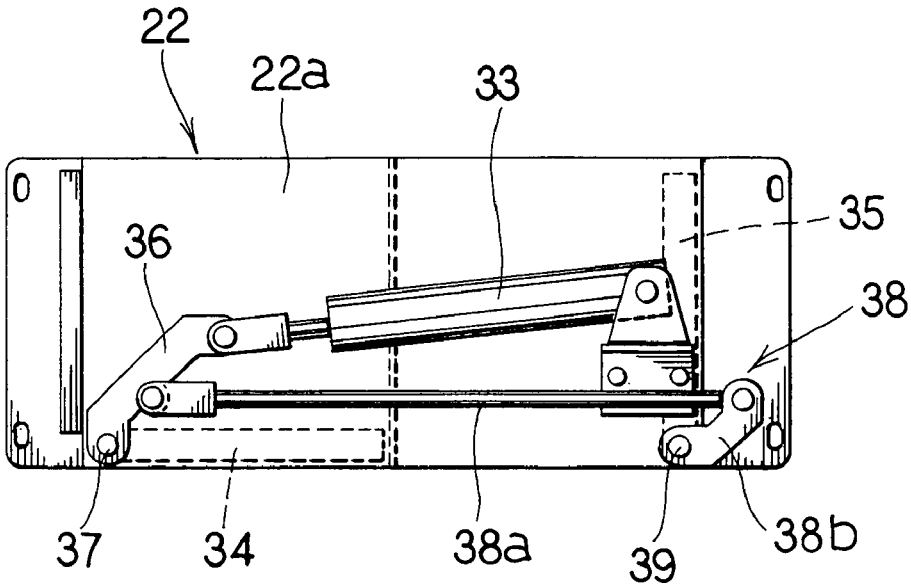
FIG. 18 is a substantial top plan view for showing another preferred embodiment of the flow path changing-over device.
Figure 19:
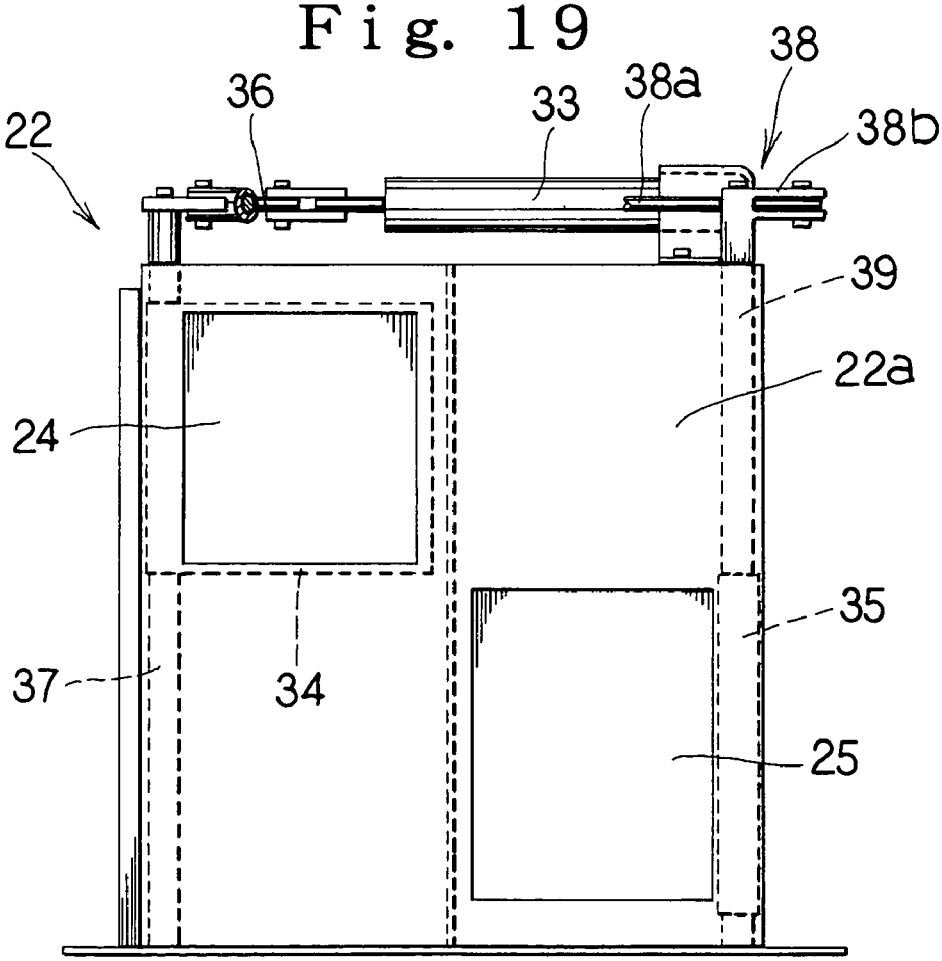
FIG. 19 is a substantial side elevational view for showing the flow path changing-over device shown in FIG. 18.
Figure 20:
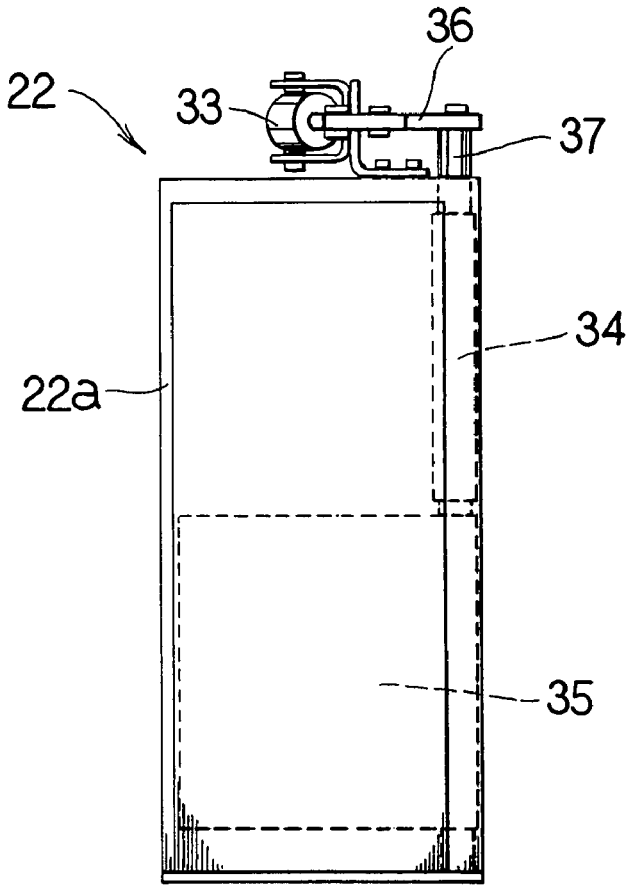
FIG. 20 is a substantial front elevational view for showing the flow path changing-over device shown in FIG. 18.

In reference to the aforesaid configuration, the clamp device 10 may be formed in such a way that it is freely raised up into a raised form around the horizontal lateral shaft 30 extending in a forward or rearward direction, as shown in FIGS. 15 to 17. Reference numeral 31 denotes a fourth air cylinder fixed to the frame with the rod being directed downward. In addition, reference numeral 32 denotes a second frame fixed in its extended form to the extremity end of the frame 14. As shown in FIG. 16, the second frame 32 is bent by 90° as seen from its top plan view and it is fixed to the extremity end of the frame 14 with a nut in such a way that it can be turned around the lateral shaft 30 by 90° in an upward or downward direction. The lower end of the rod in the fourth air cylinder 31 is displaced more right side than the lateral shaft 30 in FIG. 16 and pivoted at the end segment of the linear line part 32*a*. In this preferred embodiment, the third air cylinder 18 is fixed to the second frame 32. Other configurations are similar to those of the aforesaid example.

Next, an action of the present invention in accordance with the preferred embodiment will be described as follows.

When the rod of the fourth air cylinder 31 is retracted under a state shown in FIG. 15, the clamp device 10 is turned around the lateral shaft 30 in a counter-clockwise direction by 90° together with the second frame 32. With this operation, the clamp device 10 is raised up into its raised-up state. Additionally, when the rod of the fourth air cylinder 31 is extended, the clamp device 10 is turned by 90° in a counter-clockwise direction and is arranged in a horizontal state.

When the present invention is applied, the clamp device 10 can be arranged at its raised state after it is pulled down together with the frame 14 and the second frame 32. Accordingly, in accordance with this arrangement, even if a suite having the sleeves suspended down straight is applied, the clamp device 10 can be positively clamped neat while the clamp device 10 is oppositely faced against the end segment of the sleeve.

In addition, it is also applicable in the present invention that the aforesaid flow-path changing-over device 22 is constituted as shown in FIGS. 18 to 21. This flow-path changing-over device 22 has, on the upper surface of the flow-path changing-over box 22*a*, a fifth air cylinder 33 spaced apart from the upper surface and arranged in a horizontal state; a lid-like first valve 34 for use in opening or closing the opening part of the suction path 24 (refer to FIG. 19) under an extending or retracting operation of the rod of the fifth air cylinder 33; and a lid-like second valve 35 for use in opening or closing the opening part of the air feeding path 25. The first valve 34 and the second valve 35 are made such that the peripheral portions abutted against the inner surface of the flow-path changing-over box 22*a* are formed by resilient material such as rubber material in such a way that each of the opening parts of the suction path 24 and the air feeding path 25 can be sealingly closed in a positive manner.

The extremity end of the rod of the aforesaid fifth air cylinder 33 is pivoted to one end of the horizontal extended plate 36, and the other end of the extended plate 36 is fixed to the upper end of the first rotating shaft 37 raised in a vertical manner at the front corner part of the flow-path changing-over box 22*a*. The aforesaid first valve 34 is fixed to the first rotating shaft 37 in a vertical manner in correspondence with the opening part of the suction path 24 and this is turned together with the first rotating shaft 37.

Reference numeral 38 denotes a link mechanism for use in transmitting the extending or retracting operation of the fifth air cylinder 33 to the second valve 35 and turning the second valve 35 by 90°. This link mechanism 38 comprises a horizontal rod member 38*a* having its extremity end pivoted at the barrel part of the extended plate 36 and a horizontal link piece 38*b* pivoted at the rear end of the rod member 38*a*.

Reference numeral 39 denotes a second rotating shaft raised in a vertical manner at the rear corner part of the flow-path changing-over box 22*a*. One end of the link piece 38*b* is fixed to the upper end of the second rotating shaft 39 and the other end of the link piece 38*b* is pivoted to the rear end of the rod member 38*a*. The second valve 35 is fixed in a vertical manner to the second rotating shaft 39 in correspondence with the opening part of the air feeding path 25 and is turned together with the second rotating shaft 39. Each of the opening parts of the suction path 24 and the air feeding path 25 of the flow-path changing-over box 22*a* is displaced in a slant manner in compliance with the positions of the air discharging port 28 (refer to FIG. 1) and the suction port 29 in the base part 23 (refer to FIG. 19).

Then, an action of the flow-path changing-over device 22 will be described in reference to FIG. 21.

Figure 21:
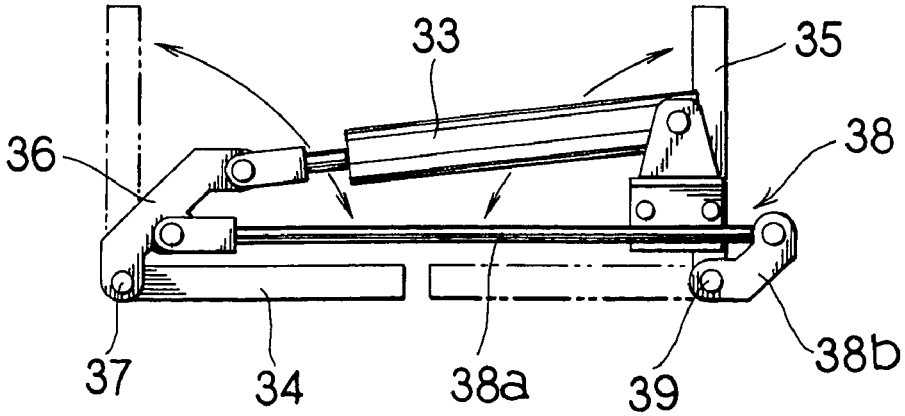
FIG. 21 is a substantial top plan view for illustrating an action of the flow path changing-over device shown in FIG. 18.

At first, when the rod of the fifth air cylinder 33 is extended, the first valve 34 is turned by 90° in a counter-clockwise direction together with the first turning shaft 37 as indicated by dotted chain line in FIG. 21. At this time, the second valve 35 is turned in a counter-clockwise direction together with the second rotating shaft 39 because the rod member 38*a* and the link piece 38*b* of the link mechanism 38 are drawn in a forward direction. With this arrangement, the opening part of the suction path 24 is opened by the first valve 34 and the opening part of the air feeding path 25 is closed by the second valve 35. Accordingly, the discharging port 28, the suction path 24, the suction port 21*f* having a filter and the inner part of the casing 21*d* are communicated to each other, the inner side of the torso 2 is sucked by the blower 21 and the shirt 1 is adsorbed against the torso 2.

In addition, when air is fed into the sleeve, the rod of the fifth air cylinder 33 is retracted. Then, the first valve 34 is turned by 90° in a clockwise direction, the opening part of the suction path 24 is closed and the discharging port 28 is closed. In addition, upon receiving of the retracting operation of the rod, the rod member 38*a* and the link piece 38*b* of the link mechanism 38 are drawn in a rearward direction, and the second valve 35 is turned by 90° in a clockwise direction together with the second rotating shaft 39. With this operation, the opening part of the air feeding path 25 is opened and the suction port 29 is released. Accordingly, the air feeding path 25, the suction port 29 and the inner part of the torso 2 are communicated to each other, air is sent from the blower 21 to the sleeve and the sleeve is finished in tension.

When the flow-path changing-over device 22 is formed in this way, the shielding plate 26 for the discharging port (refer to FIG. 1) does not protrude in front of the base part 23. Accordingly, with this arrangement, a worker can perform a work safely without paying any attention to the feet.

What is claimed is:

1. A shirt finishing machine comprising a torso for putting on a shirt, a pair of right and left supporting arms arranged at both sides of the torso and inclined toward a side of the torso to draw the sleeve of the shirt and a clamp device arranged at the upper segments of the supporting arms to hold the end segment of the sleeve of the shirt and fix it, wherein said clamp device is turned by 90° around a shaft arranged in a direction crossing at a right angle with a longitudinal direction of the supporting arms and along an inclining direction of the supporting arm and it can be freely changed over between a vertical orientation and a lateral orientation, it is moved up and down along the longitudinal direction of the supporting arm and its height can be freely adjusted, wherein the clamp device is formed in such a way that it may be raised in a raised state around the horizontal lateral shaft along a forward or rearward direction, and wherein the clamp device includes a first air cylinder in which a rod of the first air cylinder is faced in a front direction, and turned by 90°, a second air cylinder in which a rod of the second air cylinder is fixed to the supporting arms along a longitudinal direction thereof and arranged in such a way that it can be freely moved, and a third air cylinder in which a rod of the third air cylinder is faced in a lower direction and raised in the raised state.

2. The shift finishing machine according to claim 1, wherein there are provided a sensor for outputting a signal when a limit of drawing state of the sleeve of the shirt is reached and a controller for receiving a signal from the sensor and outputting a stop signal in inclining operation to a driving device for the supporting arm.

3. The shirt finishing machine according to claim 1, wherein there are provided a blower for sucking an inner side of a torso, absorbing a shirt against the torso and feeding air into the sleeve of the shirt through the inner side of the torso, and a flow-path changing-over device for changing-over a flow-path of air connecting the blower with the inner side of the torso in their communicated state between the time of sucking air and the time of feeding air.

* * * * *